United States Patent [19]

McMurchie

[11] 4,180,271

[45] Dec. 25, 1979

[54] SQUIGGLE GAME

[76] Inventor: Thomas McMurchie, 11148 Forest Edge Dr., Reston, Va. 22090

[21] Appl. No.: 923,312

[22] Filed: Jul. 10, 1978

[51] Int. Cl.[2] ..... A63F 3/00

[52] U.S. Cl. ..... 273/275

[58] Field of Search ..... 273/258, 275

[56] References Cited

U.S. PATENT DOCUMENTS

| | | | |
|---|---|---|---|
| 2,585,268 | 2/1952 | Olsen | 273/275 X |
| 3,075,771 | 1/1963 | Dodge | 273/275 |
| 3,309,092 | 3/1967 | Hardesty | 273/275 X |
| 3,741,545 | 6/1973 | Weisbecker | 273/258 |

FOREIGN PATENT DOCUMENTS

| | | | |
|---|---|---|---|
| 633951 | 12/1949 | United Kingdom | 273/157 R |

*Primary Examiner*—Harland S. Skogquist

*Attorney, Agent, or Firm*—Witherspoon, Lane & Hargest

[57] ABSTRACT

A game and the game apparatus are disclosed. The game apparatus comprises a game board, a plurality of cards or the like which are deployed on said game board and a plurality of identifier playing pieces. Each of the cards has a plurality of line segments marked thereon. Each end of the line segments on a card extends to an edge of the card. The line segments on each card or the like are generally curved line segments; however, one or more or all of the line segments on a given card may be straight lines. The playing area of the game board is divided into a plurality of quadrangles, preferably squares, having the same size as the size of the cards. To begin the game, each player in turn places a card on the game board such that one end of the line segment touches an edge of the game board playing area. The edges of the playing area of the game board contain a plurality of start marks. The line selected by each player is aligned with one of these start marks and that line then becomes that player's line. The player places one of the identifier playing pieces on the start mark on the board to identify his line. The identifier playing pieces have either different shapes or colors or both so that each player and his line is specifically identified. Each player in turn selects a card to continue his line segment and the object of the game is for each player to form a continuous line without having both ends of the line terminate at an edge of the play area of the game board. Any player having both ends of his line touching an edge of the playing area, the same edge or different edges, is out of the game.

7 Claims, 20 Drawing Figures

SQUIGGLE GAME

BACKGROUND OF THE INVENTION

This invention relates to games and more particularly to game apparatus comprising a game board, a plurality of cards, tiles or the like having line segments marked thereon and a plurality of identifier playing pieces.

Many different games utilizing playing pieces and a game board have been devised and are available on the market. Many of these prior art games utilize dice, spinners or the like to determine how a player moves his playing piece or pieces. Such games are generally games of chance and therefore require little skill on the part of the players.

There are of course known prior art board type games that do require skill and imagination on the part of a player if he is to be a successful player, chess for example. This invention relates to the type of game that requires skill, thought and imagination on the part of the players.

SUMMARY OF THE INVENTION

A game and the apparatus for playing the game is disclosed. The apparatus includes a game board having a plurality of equal size squares marked on one of its surfaces. A plurality of playing cards, tiles or the like are deployed on the game board during the playing of the game. Each card, tile or the like has a plurality of line segments marked on one of its surfaces. The line segments carried by each card are generally curved line segments, however, one or more or all line segments on a given card may be a straight line. Both ends of each line segment on a card extend to an edge of the card. Since some or all of the line segments on a given card are curved, the two ends of a line segment may extend to the same edge or different edges of the card. If the line segment is a straight line, it is obvious that one end extends to the opposite edge of the card. Preferably, the line pattern on each of the cards is different; however, two or more cards may have identical line segment patterns.

Two embodiments of the invention are disclosed. The two embodiments comprise the same structure; however, in the second embodiment the line segment patterns on the plurality of cards, tiles or the like are more complex and, as will be apparent, provide diagonal line play.

The playing area of the game board is divided into a plurality of equal size quadrangles, preferably squares. The size of the squares on the game board is equal to the size of each of the plurality of cards. Start positions or marks are provided adjacent the outer side or edge of each of the outermost squares on the game board. In the first embodiment of the invention, two such start marks are associated with each square except a corner square. Four start marks are associated with each corner square of the game board. In the second embodiment, three start marks are associated with each outermost game board square with the corner squares having five associated start marks.

At the start of the game, each player places the card he has chosen on one of the outermost squares of the game board. At least one of the line segments will be aligned with each one of the start marks associated with that square. The player chooses the line segment he wants to use during the game and places one of the identifier playing pieces provided with the game of this invention on the start mark associated with that line segment. The identifier playing pieces are either different in color or shape or both so that each player's line is clearly identified by the identifier playing piece he has selected.

After each player has placed his first card on the game board, the players in turn select additional cards one at a time. Each player places the card he selects on the game board squares in such a manner so as to continue the line he has chosen on his first card without having the line terminate at an edge of the playing surface. That is, one end of each of the lines of each player starts at a start mark along the edge of the playing area of the game board and the object of the game is for each player to continue his line without having the other end of his line terminate at another start mark. If both ends of a player's line terminate at a start mark he is out of the game. A player may be judicious in selection and placement of cards to force another player's line toward or to an edge of the playing area of the board thereby forcing that player out of the game. However, in so doing, the player must continue his line. That is, a player cannot play his cards adjacent another player's cards to force that player's line toward an edge of the playing surface unless the placement of the card continues his line.

The game of this invention can provide hours of enjoyment. Further, successful playing of the game of this invention requires thought and imagination. One must judiciously choose and play his cards if he wishes to remain in and win the game.

BRIEF DESCRIPTION OF THE INVENTION

A full and complete understanding of this invention can be obtained from the following detailed description when read in conjunction with the annexed drawing in which:

FIG. 1 shows the game board of the first embodiment of the invention;

FIGS. *2a* through *2f* shows some of the playing cards utilized with the game board of FIG. 1;

FIGS. *5a* through *5e* show some of the playing cards utilized with the game board of FIG. 5; and FIGS. 6 through 11 illustrate the preferred method of playing the game of this invention.

DETAILED DESCRIPTION OF THE INVENTION

Figure 1:
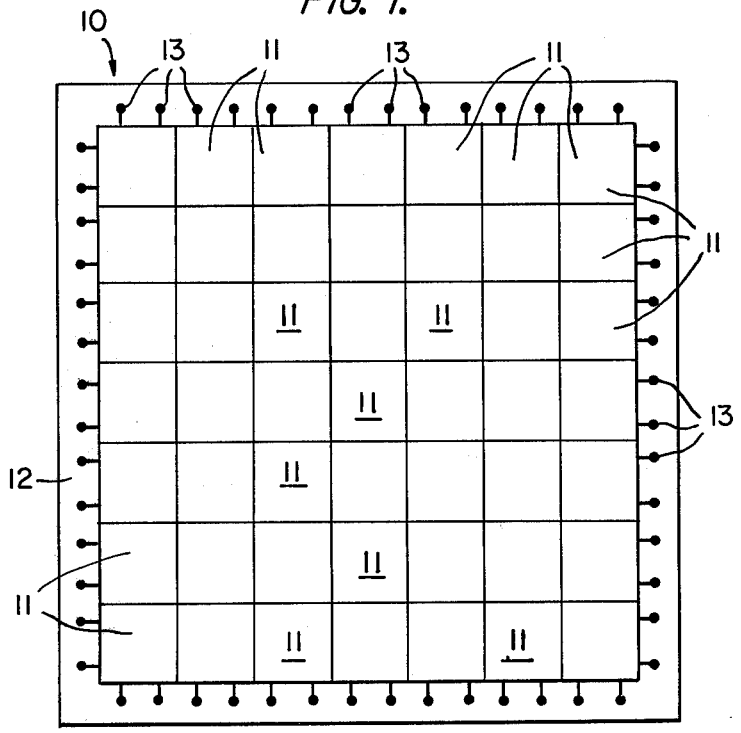

Referring to FIG. 1, the first embodiment of the invention includes a game board 10 having one surface divided into a plurality of equal size squares 11. Squares 11 constitute the playing surface or area. While the divisions 11 are shown as squares, and preferably are squares, they may also be rectangular, for example. However, for the balance of the description herein the divisions 11 will be called squares 11. A border 12 is formed between the outer edges of game board 10 and the outermost sides of the outer squares 11. Border 12 carries a plurality of start positions or marks 13. Two start markers 13 are associated with the outer side of each of the outermost squares 11. Of course, four start marks 13 are associated with each corner square 11.

Figure 2A:
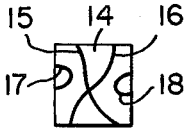
Figure 2B:
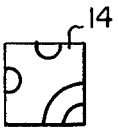
Figure 2C:
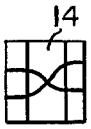
Figure 2D:
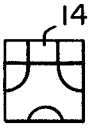
Figure 2E:
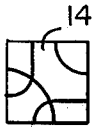
Figure 2F:
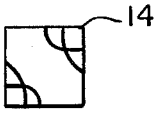

FIGS. 2*a* through 2*f* show typical playing cards 14 used with the game board 10. Playing cards 14 are all equal size and equal in size to squares 11. Cards 14 have line segments formed on one surface as shown in FIGS. 2*a* through 2*f*. For example, card 14 of FIG. 2*a* carries the line segments 15, 16, 17 and 18. Line segments 15 and 16 are curved line segments that extend from the top edge of card 14 to the bottom edge. Line segment 17 is an arc having both ends terminating at the left edge and line segment 18 is an arc having both ends terminating at the right edge of card 14. FIGS. 2*a* through 2*f* show other line segment patterns formed on the respective cards 14. As illustrated, the line segments may all be curved line segments or a combination of straight line segments and curved line segments. Further, although not illustrated all the line segments on a given card 14 may be straight line segments. Thus, FIGS. 2*a* through 2*f* are to be considered as illustrative of the line segment patterns of cards 14. However, all of the line segment patterns do have a common characteristic. This characteristic is that one end of two line segments or the two ends of a single line segment terminate at each edge of a card 14 and the ends of line segments are so placed and spaced on a card 14 that one end of two line segments or the two ends of a single line segment will be aligned with two of the start marks 13 on boarder 12 when a card 14 is properly placed on an outer square 11 of the game board 10. For example, if card 14 of FIG. 2*a* is placed on the upper left hand block 11 of game board 10 and is oriented as shown in FIG. 2*a*, the upper ends of line segments 15 and 16 will be aligned with the upper two start marks of corner block 11 and the ends of line segment 17 will be aligned with start marks 13 along the left side of the corner block 11. Any card 14 placed on a corner block 11 will have line segment ends in alignment with four starter marks.

Figure 3:
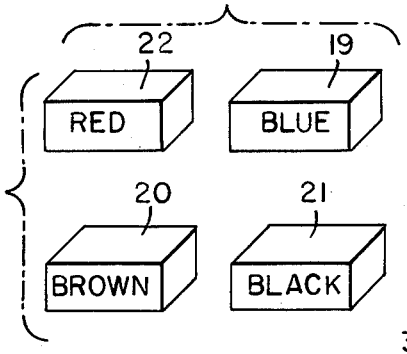
FIG. 3 shows typical identifier playing pieces of the game of this invention.
Figure 5A:
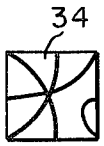
Figure 5B:
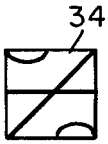
Figure 5C:
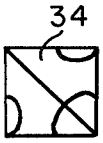
Figure 5D:
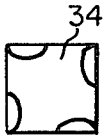
Figure 5E:
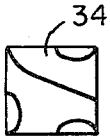

Referring to FIG. 3, this figure shows typical player identifier pieces 19, 20, 21 and 22. As shown in FIG. 3 these playing pieces are distinguishable from one another by color. Thus, piece 22 is red, 19 is blue, 20 is brown and 21 is black. Identifier pieces 19, 20, 21, and 22 may be made into any shape or color. The important factor is that pieces 19, 20, 21 and 22 be distinguishable from one another. This can be accomplished by color, shape or both.

Figure 4:
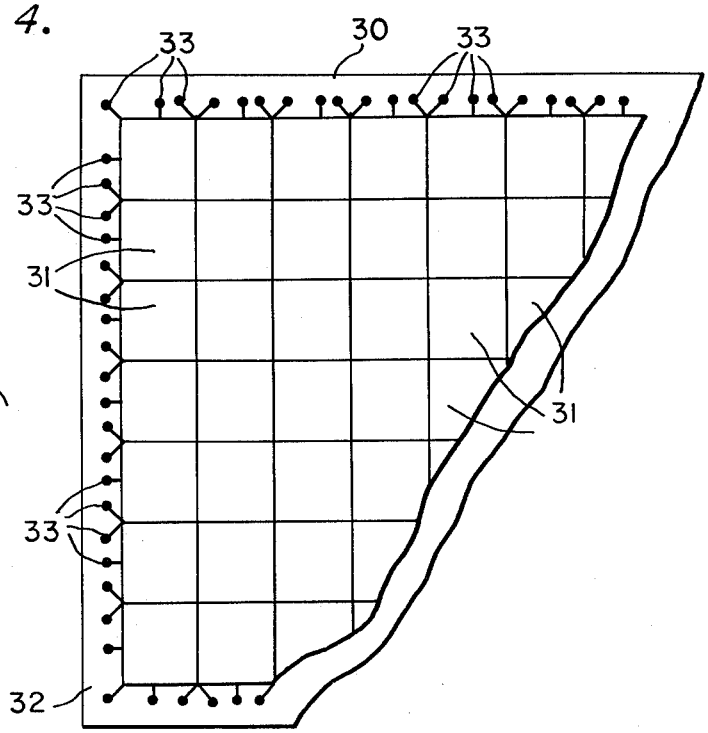
FIG. 4 is a fragmentary view of the game board constructed in accordance with a second embodiment of this invention.

FIG. 4 shows a segment of the game board 30 of a second embodiment of the invention. Game board 30 is merely a variation of game board 10 of FIG. 1. Thus, game board 30 is divided into a plurality of equal size squares 31 with the start marks 33 placed in the border 32 that is formed between the outside edges of game board 30 and the outer edges of the playing area. The only difference between game board 30 and game board 10 is the manner in which start marks 33 are positioned and the number of start marks associated with each outer square 31 as compared to the position and number of start marks 13 associated with each outer square 11 of game board 10. Three start marks 33 are associated with each square 31, five start marks 33 with each corner square 31. One start mark is positioned essentially in the middle of the outer edge of an outside block 31 and one start mark 33 is positioned at each corner.

FIGS. 5*a* through 5*e* show the playing cards 34 that are used with game board 30. As is the case with playing cards 14, playing cards 34 carry line segment patterns where each end of a line segment terminates either at different edges of the card or at the same edge. The line patterns may consist of all curved line segments, curved line segments together with straight line segments or all straight line segments. Therefore, cards 34 shown in FIGS. 5*a* through 5*e* are merely illustrative of the line patterns found on cards 34. Generally, each card 34 will have a different line segment pattern although two or more cards may have the same pattern. The only restriction to the line segment patterns formed on cards 34 is that three line segment ends must terminate at each edge of a card 34 and these three ends must be so spaced that a different line segment end will be aligned with each of the start marks 33 when a card 34 is properly placed on one of the outer blocks 31. This is the same restriction placed on segment patterns on cards 14 of FIGS. 2*a* through 2*f* with respect to start marks 13 of board 10 of FIG. 1 as described above.

Identifier pieces 19, 20, 21 and 22 are also used with game board 30. In fact, the playing of the game is the same with either game boards 10 or 30. The only difference is that cards 14 are used with game board 10 and cards 34 are used with game board 30. In addition, game board 30 together with cards 34 provide a slightly more complex game when compared to game board 10 and cards 14. With game board 30 and cards 34 diagonal lines are provided. Game board 10 and cards 14 do not provide these diagonal lines.

RULES OF THE GAME AND METHOD OF PLAY

For both embodiments, the preferred form of the invention provides a board game for 2 to 8 players and comprises a game board (board 10 or 30), 8 individually distinguishable player, identifier pieces (such as player identifier pieces 19, 20, 21 and 22) a deck of 35 playing cards (cards 14 for board 10 and cards 34 for board 30) and an additional card conveniently called the NEXT card. The NEXT card is not shown in the drawing and is merely an additional card of the same size and shape as cards 34 and 14. The NEXT card is distinguishable from the playing cards 14 or 34 and may for example have the name of the game (SQUIGGLE) printed on one surface and/or a design. In its typical or preferred form, with a deck of 35 playing cards, the game board 10 has 36 squares 11 and the game board 30 has 36 squares 31.

In the following discussion of the rules and method of play, it will be assumed that game board 10 and cards 14 are being used and it is assumed that game board 10 has 36 squares 11 and that therefore there are 35 playing cards 14.

To start the game, each player choses one of the identifier playing pieces. The NEXT card is removed from the pack of playing cards and the cards are then shuffled. After the playing cards are shuffled, each player is dealt three cards and then the NEXT card is placed on the bottom of the deck of cards and the cards are placed in a convenient location, face down.

The player who is going to be the first player is selected by any means agreed to by the players and this first player then selects one of the 48 start marks (there are 48 start marks on a 36 square game board 10 and 68 start marks on a 36 square game board 30) along the edge of the playing area of the board and places his playing piece there. Each player in turn (clockwise around the board) selects an unoccupied start mark and places his identifier piece on that start mark. A player may examine his three playing cards before he selects a start mark.

After all of the start marks have been chosen and the player identifier pieces are on the chosen start marks, the first player selects one of his three playing cards and places the selected card in any orientation on the vacant board square adjacent his identifier piece. This creates the path or line which starts at the players identifier piece. The player now moves his identifier piece to the free end of his path and draws the top card from the pack to replace the one he played. Each player in turn, clockwise (from right to left) selects one of his three cards, places it on the square adjacent his identifier piece to establish his path or line, moves his identifier piece to the free end of his path, and then draws a card from the pack to replace the one played. Play then continues, in turn clockwise, with each player placing a card from his hand on an unoccupied square so as to extend his path or line, moving his identifier piece of the free end of his path, and drawing a replacement card from the pack. When a card has been legally played, it remains where it has been placed for the remainder of the game.

A player loses and must retire from the game if his line or path connects with another start mark on the edge of the playing area. When a player is forced to retire from the game, he shuffles his remaining cards into the pack. The last player to remain in the game is the winner.

(SHORT CUTS) If a player's path is connected to a previously unused line segment (remaining from earlier moves) it becomes part of that player's path and he must advance his identifier piece to the end of that line. (SUICIDE) A player may not connect his path to the edge of the board (thereby forcing himself out of the game) unless he cannot make any other legal move. (MEDDLING) If a player's legal move also extends another player's path, that player must advance his identifier piece to the new end of the path, including any short cuts. (COLLISIONS) If the paths of two players are connected together, both players must retire from the game. In effect, each player's path functions as a short cut to the edge of the board for the other player. (INHERITANCE) If a player's legal move forces one or more players (but not himself) out of the game, then that player is permitted to select (inherit) cards from the hands of the eliminated player or hands of the eliminated players in the follows manner: Before drawing a replacement card from the deck, the player may exchange any of the cards in his hand with exactly the same number of cards from the player or players he eliminated. The remaining cards are then shuffled into the pack. The player must, as usual, draw his replacement card from the pack. (THE NEXT CARD) The first player who cannot draw a replacement card (because the pack has been exhausted) must draw and keep the NEXT card until more cards become available. The NEXT card cannot be used on the board; it is only used to simplify remembering which player has first claim on cards when they become available. When a player holds the NEXT card and additional cards become available because one or more players are forced out of the game, then the available cards are distributed as follows: The player with the NEXT card replaces it on the bottom of the pack and draws the top playing card. Players continue (clockwise) to draw replacement cards until either all players have three playing cards or until some player draws the NEXT card again. If the player who holds the NEXT card is forced out of the game, he gives the NEXT card to the player on his left. If that player already has three cards, the NEXT card is returned to the bottom of the pack of the playing cards. The NEXT card is not inherited in the manner that playing cards are inherited.

(DRAW GAMES) If all 35 cards have been played and two or more players remain in the game, the game is a draw between the remaining players. Also if all remaining players are forced out of the game on the same move, the game is a draw between the players remaining at that time.

FIGS. 6 through 11 illustrate the first few moves of the game as played by three players. Only the lower left corner of the game board is shown in these figures. In FIGS. 6 through 11, game board 10 and cards 14 are illustrated. In FIGS. 6 through 11, the identifier playing pieces and the players are numbered as follows: P-1 for player one, P-2 for player two, and P-3 for player three.

Figure 6:
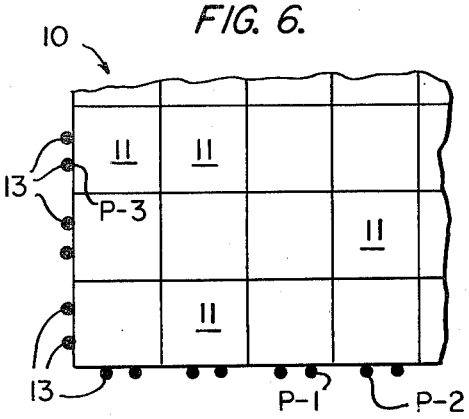

In FIG. 6, each of the three players has selected a start mark 13 and has placed his identifier playing piece next to that start mark. As shown, player P-1 has selected the second start mark 13 of the third bottom square for the bottom left corner of board 10, player P-2 has selected the first start mark in the fourth bottom square 11 from the bottom left corner board 10 and player P-3 has selected the first start mark 13 of the third square 11 going up for the bottom left corner of board 10. P-1, P-2, and P-3 not only denote the players but also denote the identifier playing pieces in FIGS. 6 through 11.

Figure 7:
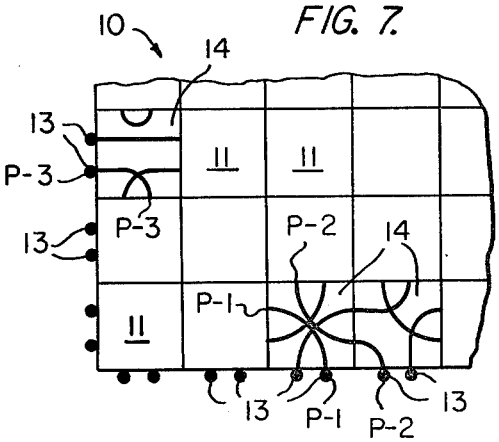

In FIG. 7, the three players have each placed their first card on the game board 10 adjacent their selected start marks. Boths ends of each player's path are labelled with the player identifier labels P-1, P-2, and P-3. In FIG. 7, player P-2 has taken a short cut across the first card 14 played by player P-1.

Figure 8:
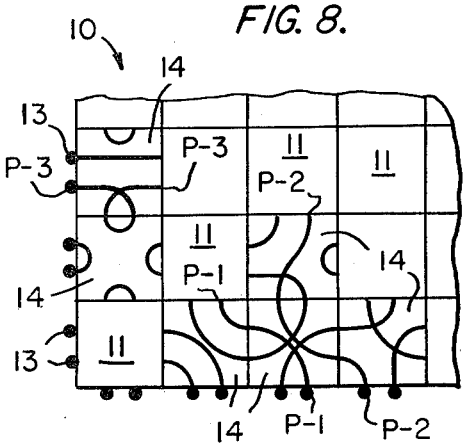

FIG. 8 shows the progress of the game after each player has placed two cards 14 on board 10. In FIG. 8, player P-3 has taken a short cut across his own first card 14. Also, player P-1 is trapped by players P-2 and P-3 and must extend his path into a square controlled by one of them (thereby giving that opponent an opportunity to meddle). Note that the square 11 in the lower left corner of board 10 is no longer accessible.

Figure 9:
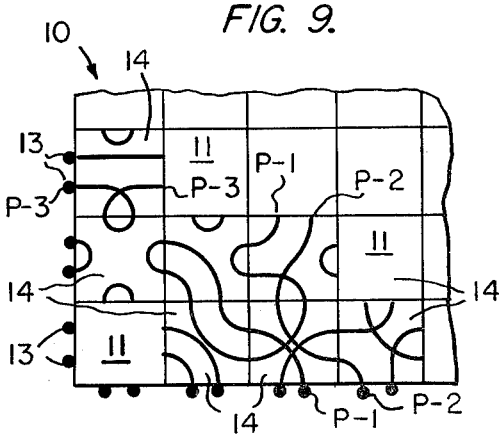

FIG. 9 shows the progress of play after player P-1 has played his third card 14. As shown in FIG. 9, player P-1 has elected to play into the square controlled by player P-2, via a rather circuitous route. Thus, player P-2 has the opportunity to meddle with player P-1.

Figure 10:
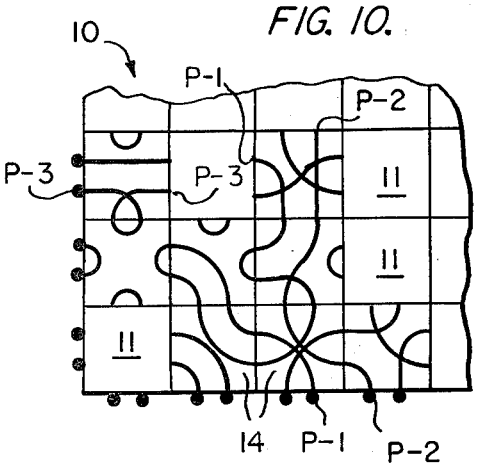
Figure 11:
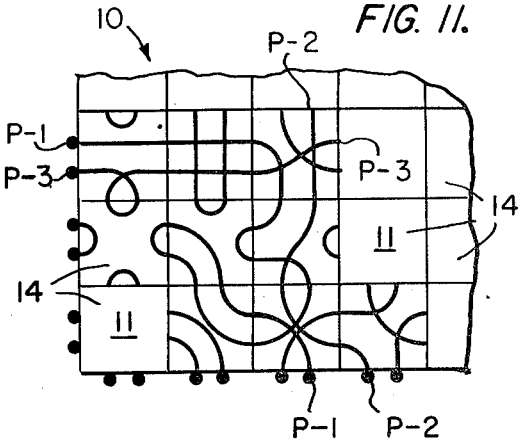

FIG. 10 illustrates the progress of play after player P-2 has placed his third card on board 10. As shown in FIG. 11, player P-2 has chosen to proceed straight across the square while simultaneously delivering player P-1 into the clutches of player P-3. As illustrated in FIG. 11, player P-3 has shown no mercy toward player P-1 and has forced him out of the game. Player P-3 may now inherit any of the cards from player P-1, if player P-3 prefers them to his own. Players P-2 and P-3 now continue to play until one of them is either forced out of the game or play is a draw.

From the foregoing description of play as illustrated by FIGS. 6 through 11, it should be obvious that the game disclosed is a game of skill that requires thoughtful selection and deployment of the playing cards and planning of each succeeding move. Each player must attempt to place his playing cards such that he will not terminate his path or play into a position where another player can force him out of the game. In addition, each player will want to attempt to place his cards such that he can force another player out or into a position from which he can be forced out by another player without placing himself in a dangerous position. While FIGS. 6 through 11 illustrate the play of the game using board 10, it should be obvious that the game is played in an identical manner using game board 30 and cards 34. With game board 30 and cards 34, the game is somewhat more difficult since game board 30 and cards 34 provide the additional diagonal line of play.

As has been mentioned above, both embodiments in their preferred forms provide a board game for 2 to 8 players that includes a game board divided into 36 equal size squares, 8 player identifier pieces, a deck of 35 playing cards and a NEXT card. However, it should be obvious that game boards 10 and 30 may have more or less than 36 squares and that proportionately more or less than 35 playing cards may be provided. Of course, if too few squares are furnished, the game would end rather quickly and would not be much of a challenge. Further, if the number of squares is decreased substantially, the number of players that can be accommodated will also decrease. In any event, from actual play of the game it has been found that a game board having 36 squares and a deck of 35 playing cards is an optimum configuration of the game.

While the invention has been described with reference to two specific embodiments and a prepared form of these two embodiments, it will be obvious to those skilled in the art that various modifications and changes can be made to these two embodiments without departing from the spirit and scope of the invention as set forth in the claims.

I claim:

1. A game comprising:

a game board having a quadrangular playing area that is divided into a plurality of equal sized quadrangles and having a border between the outer edges of the game board and said quadrangular playing area;

a plurality of start marks located on said border adjacent each one of the outer ones of said plurality of equal sized quadrangles;

a plurality of playing cards, each one of said plurality of playing cards being of equal size and shape to the size and shape of each one of said plurality of equal sized quadrangles and having a plurality of line segments imprinted on one surface thereof, each one of said line segments having both of its ends terminate at an edge of the said playing card on which that line segment is imprinted; and a plurality of individually distinguishable playing pieces.

2. The game as defined in claim 1 wherein the number of said plurality of line segments imprinted on one surface of each one of said playing cards is four.

3. The game as defined in claim 2 wherein said four line segments imprinted on a first number of said plurality of player cards are all curved line segments, are a combination of curved and straight line segments on a second number of said plurality of playing cards and are all straight lines on a third number of said plurality of playing cards.

4. The game as defined in claim 3 wherein the number of said plurality of start marks adjacent each one of said outer ones of said plurality of equal sized quadrangles is two.

5. The game as defined in claim 4 wherein said plurality of equal sized quadrangles are equal sized squares.

6. The game as defined in claim 3 wherein the number of said plurality of start marks adjacent each one of said outer ones of said plurality of equal sized quadrangles is three.

7. The game as defined in claim 6 wherein said plurality of equal sized quadrangles are equal sized squares.

* * * * *